United States Patent [19]

Coscia et al.

[11] Patent Number: 4,597,274

[45] Date of Patent: Jul. 1, 1986

[54] LOCK COVER MECHANISM

[75] Inventors: Charles M. Coscia, Upper Arlington; Michael K. Scott, Columbus, both of Ohio

[73] Assignee: The D. L. Auld Company, Columbus, Ohio

[21] Appl. No.: 711,969

[22] Filed: Mar. 14, 1985

[51] Int. Cl.[4] ..... E05B 17/18

[52] U.S. Cl. ..... 70/455; 70/452

[58] Field of Search ..... 70/55, 455, 452, 372, 70/423, 427, 431

[56] References Cited

U.S. PATENT DOCUMENTS

| | | | |
|---|---|---|---|
| 837,051 | 11/1906 | Gatewood . | |
| 2,213,814 | 9/1940 | Jacobi . | |
| 2,343,605 | 3/1944 | Wise . | |
| 2,400,229 | 5/1946 | Freeman . | |
| 2,454,925 | 11/1984 | Jacobi . | |
| 2,602,319 | 11/1948 | Jacobi . | |
| 3,313,136 | 4/1967 | Gulette | 70/455 |
| 3,898,824 | 8/1975 | Borlinghaus . | |
| 3,930,391 | 1/1976 | Borlinghaus . | |
| 4,192,161 | 3/1980 | Borlinghaus . | |

FOREIGN PATENT DOCUMENTS

| | | | |
|---|---|---|---|
| 651109 | 3/1979 | U.S.S.R. | 70/45 |

*Primary Examiner*—Robert L. Wolfe

*Attorney, Agent, or Firm*—Killworth, Gottman, Hagan & Schaeff

[57] ABSTRACT

A cover mechanism for covering a lock having a key opening in a lock support surface includes a cover plate which may be pivoted between a closed position in which the key opening of the lock is covered and an opened position in which the key opening is exposed. A detent arrangement includes a first stop which engages the cover plate to hold it in its opened position until insertion of a key into the key opening, whereupon a second stop of the detent arrangement engages the cover plate and prevents movement of the cover plate into its closed position until withdrawal of the key is initiated. A damping arrangement slows movement of the cover plate from its opened position into its closed position.

19 Claims, 15 Drawing Figures

LOCK COVER MECHANISM

BACKGROUND OF THE INVENTION

The present invention is directed to a lock cover mechanism for covering a lock, including a lock cylinder having a key opening, and more particularly to such a mechanism which includes a pivotally mounted cover plate and a cover plate detent arrangement for holding the cover plate in an opened position during actuation of the lock.

Lock cover mechanisms of the type to which the present invention is directed are commonly used to cover key openings of locks which latch vehicle body deck lids. Such a lock normally maintains the deck lid in closed position. A number of different cover mechanisms have been utilized in the past in which a detented cover assembly shields the lock from inclement weather conditions. Such a cover assembly generally includes a support plate mounted on the lock or the vehicle body deck lid. The support plate defines an access opening which is aligned with the lock key opening and through which a key is inserted into the lock. A cover plate is pivotally supported by the support plate and is moveable about an axis, generally normal to the plane of the cover plate, between an opened position in which a key may be inserted into the key opening, and a closed position in which the lock is completely covered.

One such detented cover assembly is disclosed in U.S. Pat. No. 3,898,824, issued Aug. 12, 1975, to Borlinghaus. In the '824 device, a leaf spring arrangement, mounted on the support plate, holds the cover plate open against the closing bias of a torsion spring after the cover has been manually opened. The leaf spring includes a detenting portion that is normally located in the path of the cover plate to prevent the plate from rotating into its closed position. The leaf spring further includes a portion adapted to be engaged and pushed outwardly from the deck lid by a cam on the lock cylinder as the cylinder is rotated into its unlocked position. The outward camming of this position of the leaf spring causes the detenting portion of the leaf spring to be moved inwardly toward the deck lid so that of the cover plate under the bias of the torsion spring.

The '824 cover assembly is disadvantageous in that the cover plate is released to move toward its closed position when the lock cylinder is rotated fully. At this point the key is still in the key opening, and the cover plate therefore moves into contact with the key. The key must then be rotated back to its vertical position and withdrawn from the key opening. Both of these steps are hindered by the key being contacted by the cover plate. Additionally, if the key is a two-sided key, over a period of time the rubbing of the edge of the key across the edge of the cover plate may damage the key. This detented cover assembly is further disadvantageous in that it requires a specially configured lock cylinder.

U.S. Pat. No. 3,930,391, issued Jan. 6, 1976, to Borlinghaus discloses a similar cover arrangement. In the '391 arrangement, however, an engagement portion of the leaf spring is positioned to contact the key as the lock cylinder is rotated during the unlocking operation. While not requiring a specially configured lock cylinder, the '391 arrangement is disadvantageous in that the body of the key is actually contacted by the leaf spring during rotation of the key, and this makes the rotation of the key somewhat more difficult. Additionally, the Borlinghaus '391 cover assembly, like the Borlinghaus '824 cover assembly, releases the cover plate when the key and lock cylinder are fully rotated, permitting the cover plate to move toward its closed position and strike the key. Thus, deterioration of the key and the cover plate over a period of time result as the key is repeatedly withdrawn from the key opening.

Accordingly, it is seen that there is a need for a cover mechanism for covering a lock in which the cover plate is held in its opened position during actuation of the lock and is only released to move back toward its closed position as the key is withdrawn from the lock key opening.

SUMMARY OF THE INVENTION

A cover mechanism for covering a lock, including a lock cylinder having a key opening, is mounted on a lock support surface. The mechanism includes a cover plate means having a cover plate pivotally mounted on a support plate secured to the lock support surface for rotation generally in the plane of the cover plate between a closed position in which the lock is covered and an opened position in which the lock is exposed for insertion of a key into the key opening. The cover plate means further includes a spring means for spring biasing the cover plate toward the closed position. The cover mechanism further includes plate detent means for inserting a first stop into the path of the cover plate after the cover plate is pivoted into its opened position so as to hold the cover plate in the opened position, for moving the first stop out of the path of the cover plate and simultaneously moving the second stop into the path of the cover plate in response to insertion of a key into the key opening so as to maintain the cover plate in the opened position, and for thereafter releasing the cover plate by moving the second stop out of the path of the cover plate as the key is withdrawn from the key opening, such that the cover plate may then be rotated into the closed position by the spring means.

The cover mechanism may further comprise damping means for damping the movement of the cover plate from the opened position to the closed position produced by the spring means, whereby a key may be fully withdrawn from the key opening prior to movement of the cover plate into the closed position. The damping means may comprise a friction element mounted on the support plate, and means defining a friction surface on the side of the cover plate facing the support plate for contacting the friction element and slowing rotation of the cover plate from the opened position to the closed position. The friction element may comprise an O-ring secured to the support plate.

The cover detent means may comprise a spring detent member secured to the support plate, with the spring detent member defining an insertion opening aligned with an access opening in the support plate and with the key opening, permitting insertion of a key therethrough into the key opening. The spring detent member further includes a first leg defining the first stop and a second leg defining the second stop. The spring detent member is spring biased such that movement of the cover plate into the opened position permits movement of the first stop into the path of the cover plate and insertion of a key into the key opening contacts the spring detent member causing the first stop to move out of the path of the cover plate and simultaneously causing the second stop to move into the path of the cover plate. The spring detent member may be spring biased such that withdrawal of a key from the key opening permits movement of the second stop out of the path of the cover plate.

The cover plate may define a contact element extending rearwardly toward the lock support surface. The second stop engages the contact element to hold the cover plate in the opened position. The contact element extends rearwardly through a slot in the support plate to contact the second stop.

The cover detent means may comprise pivot means pivotally mounted on the support plate for movement about an axis substantially parallel to the cover plate. The pivot means includes the first stop and the second stop which are positioned generally on opposite sides of the axis. The pivot means further includes pivot spring means for spring biasing the pivot means to move the first stop into the path of the cover plate when the cover plate is rotated into the opened position. The cover detent means further comprises a spring detent member secured to the support plate beneath the lock cylinder. The spring detent member defines an insertion opening aligned with the access opening and with the key opening, permitting insertion of the key therethrough into the key opening. The spring detent member further defines an actuation leg for contacting the pivot means when a key is inserted into the key opening and pivoting the first stop out of the path of the cover plate and, simultaneously moving the second stop into the path of the cover plate when a key is inserted into the key opening.

Accordingly, it is an object of the present invention to provide a cover mechanism for covering a lock, including a cover plate which is pivotally mounted for rotation generally in the plane of the cover plate between a closed position and an opened position, in which a plate detect means holds the cover plate in the opened position until withdrawal of a key from the lock is initiated; to provide such a mechanism in which a first stop holds the cover plate in its opened position until the key is inserted into the lock and then a second stop holds the cover plate in its opened position until withdrawal of the key is initiated; and to provide such a cover mechanism in which the key may be fully withdrawn from the lock without being contacted by the cover plate.

DETAILED DESCRIPTION OF THE PREFERRED EMBODIMENTS

Figure 2:
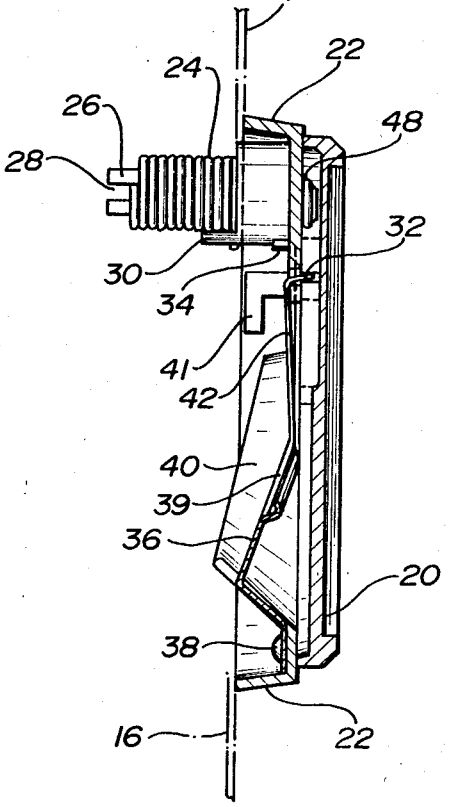
FIG. 2 is a sectional view taken generally along line 2—2 in FIG. 1.
Figure 1:
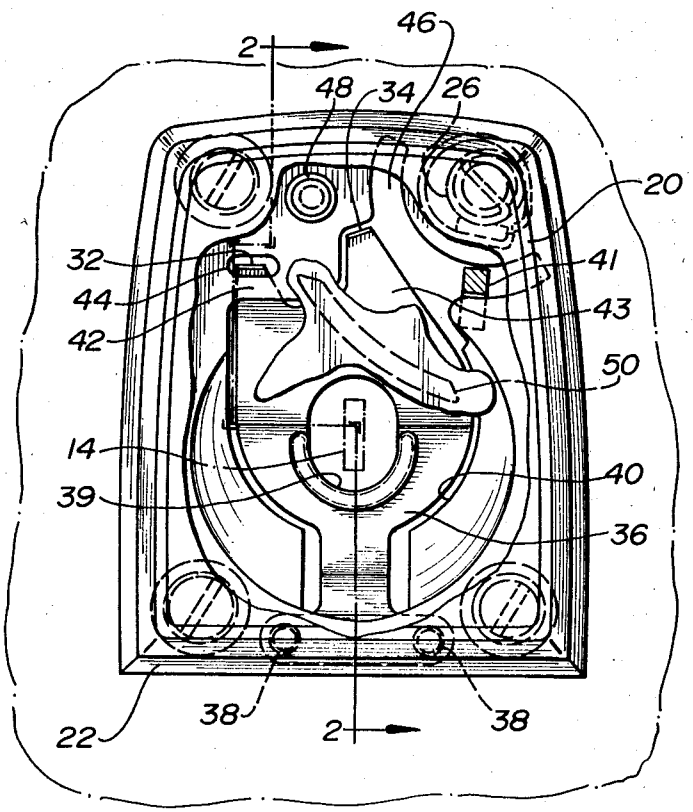
FIG. 1 is a front view of a first embodiment of the cover mechanism of the present invention with the cover plate oriented in its closed position, and with portions broken away to reveal internal structure.

FIG. 1–6 illustrate a first embodiment of the cover mechanism of the present invention for covering a lock 10 (FIGS. 4 and 6) including a lock cylinder 12 having a key opening 14. The lock 10 is mounted on a lock support surface 16. A cover plate means 18 includes a cover plate 20 pivotally mounted on a support plate 22 for rotation generally in the plane of the cover plate 20 between a closed position (shown in FIGS. 1 and 2) in which the lock 10 is covered and an opened position (shown in FIGS. 3–6) in which the lock 10 is exposed for insertion of a key into the key opening 14. The cover plate means further has a spring means including spring 24 spring biasing the cover plate 20 toward its closed position. The spring means further includes a pivot shaft 26 which extends rearwardly from the cover plate 20 through hole 28 in the support plate 22. Spring 24 is coiled about shaft 26 and attached at one end in slot 28 and at its opposite end to the support plate 22 by being clipped around projection 30.

Figure 4:
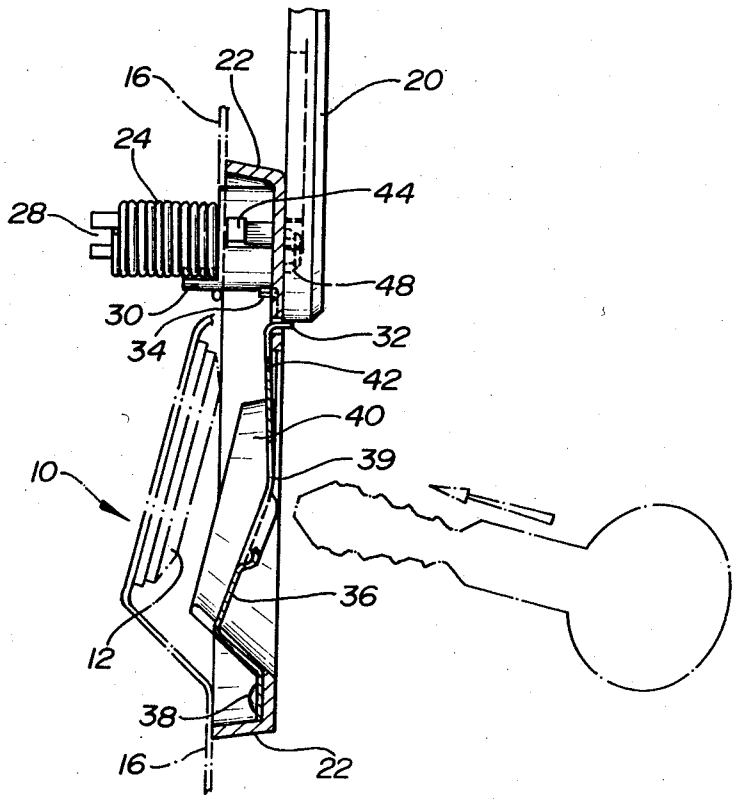
FIG. 4 is a sectional view, similar to FIG. 2, with the cover plate held in its opened position by the first stop.
Figure 3:
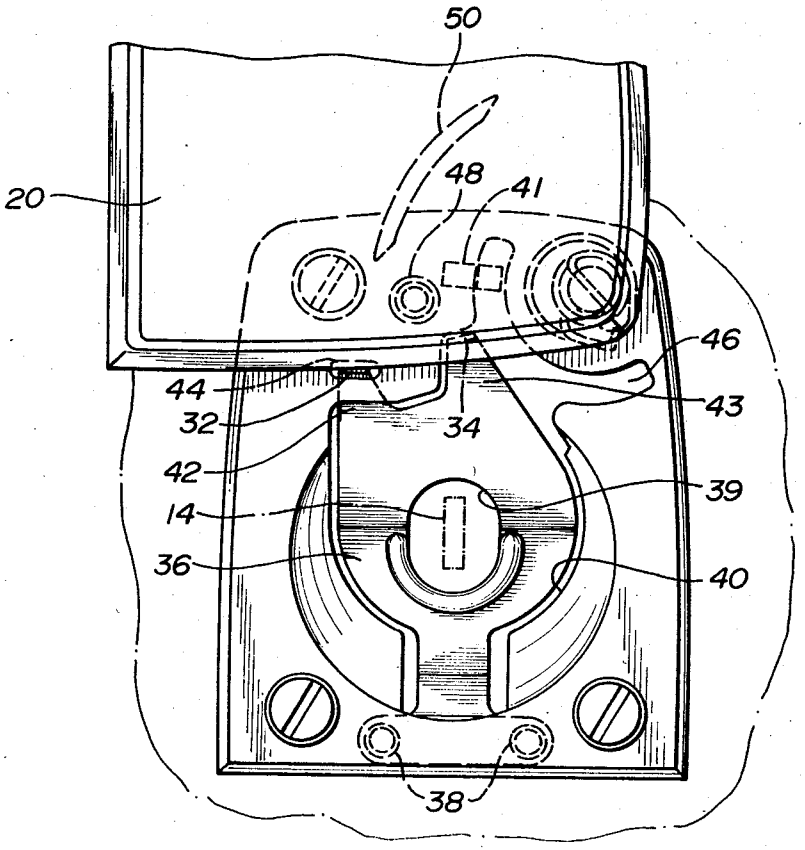
FIG. 3 is a front view similar to FIG. 1 with the cover plate held in its opened position by a first stop.
Figure 6:
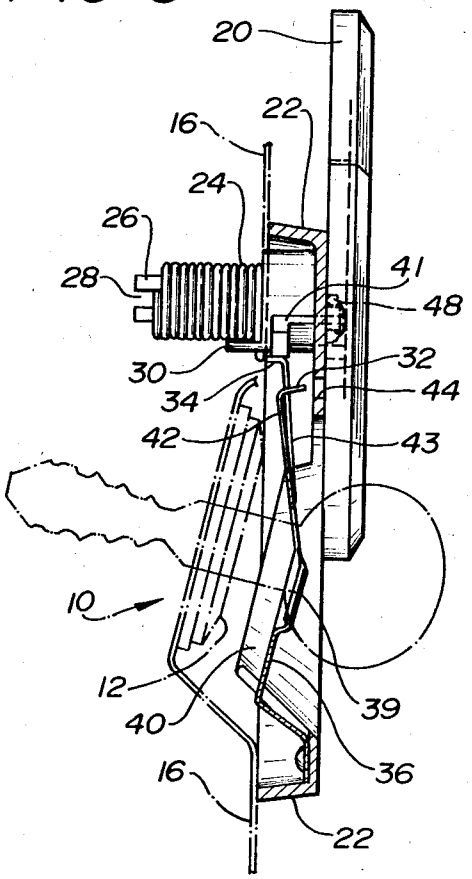
FIG. 6 is a sectional view, similar to FIG. 2, with the cover plate held in its opened position by the second stop.
Figure 5:
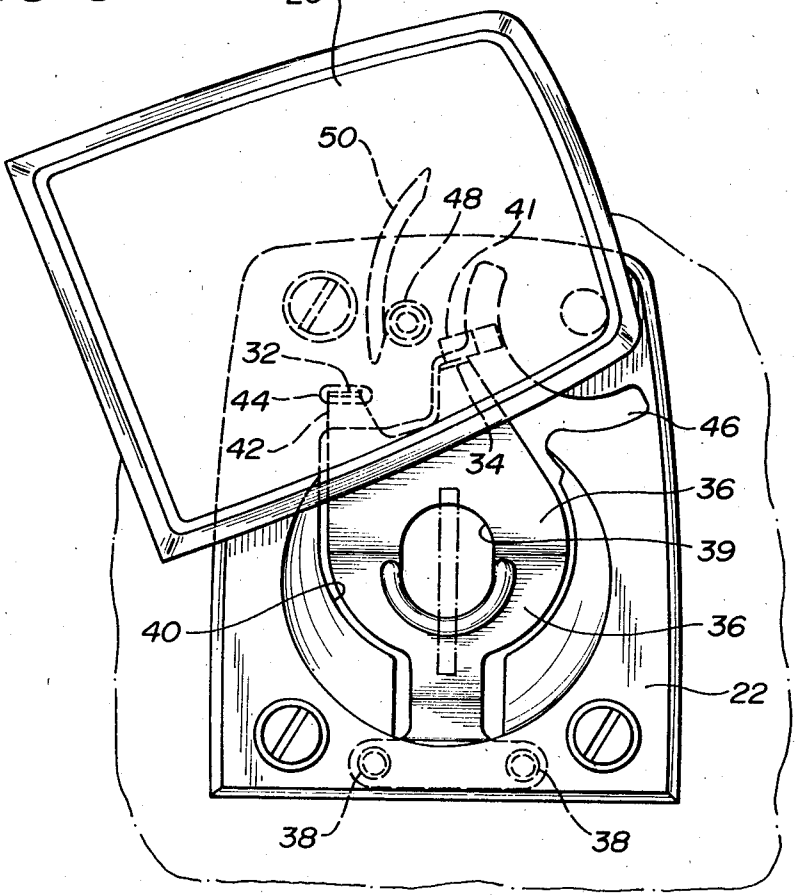
FIG. 5 is a front view, similar to FIG. 1, with the cover plate being held in its opened position by a second stop.
Figure 8:
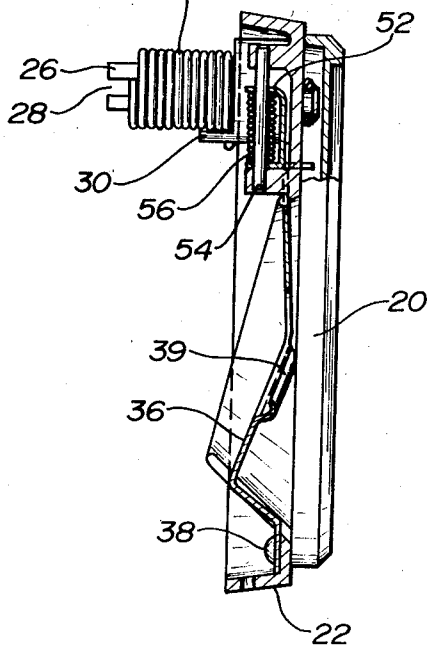
FIG. 8 is a sectional view taken generally along line 8—8 in FIG. 7.
Figure 9:
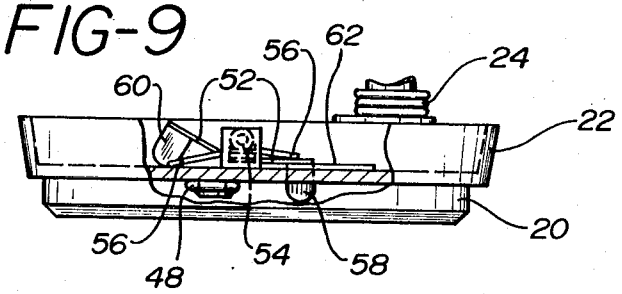
FIG. 9 is a top view of the cover mechanism of FIG. 7, with portions broken away to reveal internal structure.
Figure 7:
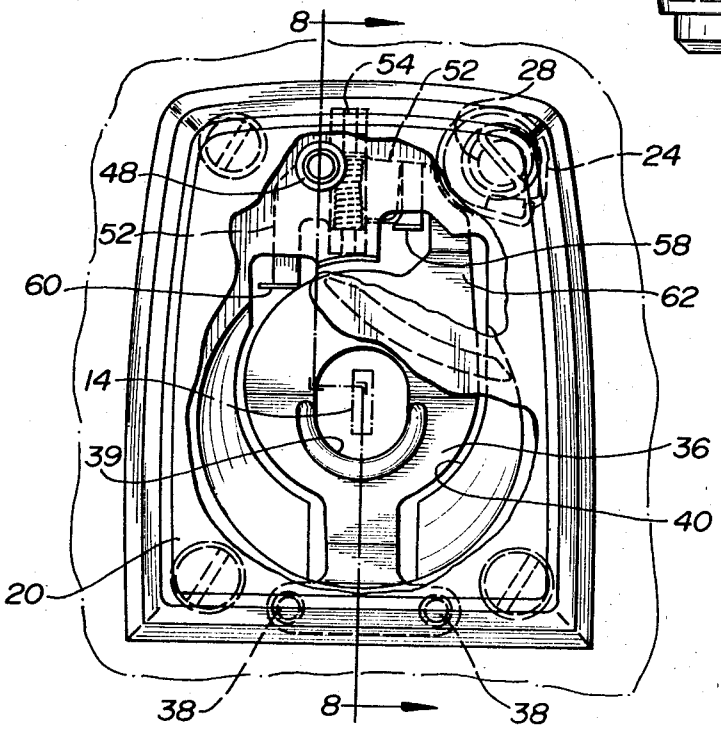
FIG. 7 is a front view of a second embodiment of the cover mechanism of the present invention with the cover plate oriented in its closed position, and with portions broken away to reveal internal structure.

As described more completely below, the cover mechanism of the present invention includes a plate detent means which inserts a first stop 32 into the path of the cover plate 20 after the cover plate is manually pivoted into its opened position, as illustrated in FIGS. 3 and 4. The plate detent means moves the first stop 32 out of the path of the cover plate 20 and simultaneously moves a second stop 34 into the path of the cover plate 20 in response to insertion of a key into the key opening 14. The second stop 34 therefore maintains the cover plate 20 in its opened position, as illustrated in FIGS. 5 and 6. The key is then rotated so as to actuate the lock and returned to its vertical position. During this time, the plate 20 is held in its opened position by the stop 34. As the key is withdrawn from the key opening 14, the plate detent means releases the cover plate by moving the second stop 34 out of the path of the cover plate. The cover plate 20 is then rotated into its closed position by the spring 24.

The plate detent means includes a spring detent member 36 which is staked at two points 38 to the support plate 22. Member 36 defines an insertion opening 39 which is aligned with an access opening 40 in the support plate 22. When a key is inserted into the key opening 14, the spring detent member is deflected toward the lock 10, thus moving the first stop 32 toward the lock 10 and disengaging it from the cover plate 20 while simultaneously causing the second stop 34 to engage a contact element 41 which extends rearwardly from the plate 20. This is shown in FIGS. 5 and 6. The spring detent member 36 holds the cover plate 20 in its opened position until withdrawal of the key from the key opening 14 is initiated, at which time the spring detent member moves away from the lock 10, taking the second stop 34 out of contact with the contact element 41 and allowing cover plate 20 to be returned to its closed position by the spring force of spring 24.

In the embodiments of FIGS. 1–6, the spring detent member includes a first leg 42 connected to the first stop 32 and a secod leg 43 connected to the second stop 34. Stop 32 extends through opening 44 in the support plate 22. Stop 34 extends rewardly from the detent member 36 to contact the contact element 41. Element 41 extends through slot 46 in support plate 22.

In order to slow down the movement of the cover plate 22 from its opened position to its closed position, a damping means is provided from damping the movement of the cover plate. This permits a key to be withdrawn fully from the key opening 14 prior to the movement of the cover plate into its closed position, thereby precluding the key from being contacted by the cover plate 20. The damping means comprises an O-ring 48 which is mounted on the support plate 22 and which acts as a friction element. Cooperating with the friction element O-ring is a friction surface defined by ridge 50 on the side of the cover plate 20 facing the support plate 22. Note that in FIG. 1 the central area of the cover plate is broken away to reveal internal structure, with the exception of the center area including the ridge 50. It will be appreciated that this damping arrangement enhances operation of the cover mechanism of the present invention but that even without the damping arrangement, the cover mechanism maintains the cover plate in its opened position throughout rotation of the lock cylinder and precludes the cover plate from contacting a key during this operation.

Reference is now made to FIGS. 7–15 which illustrate a second embodiment of the cover mechanism of the present invention. In these figures the same reference numerals have been used to identify parts which are common to the two embodiments.

Figure 12:
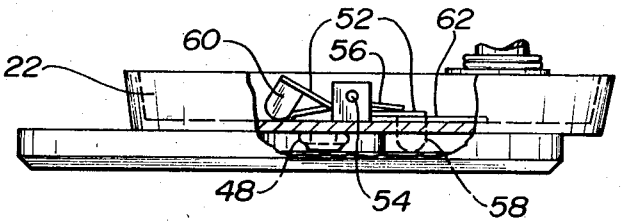
FIG. 12 is a top view with portions broken away to reveal internal structure, similar to FIG. 9, with the cover plate held in its opened position by the first stop.
Figure 11:
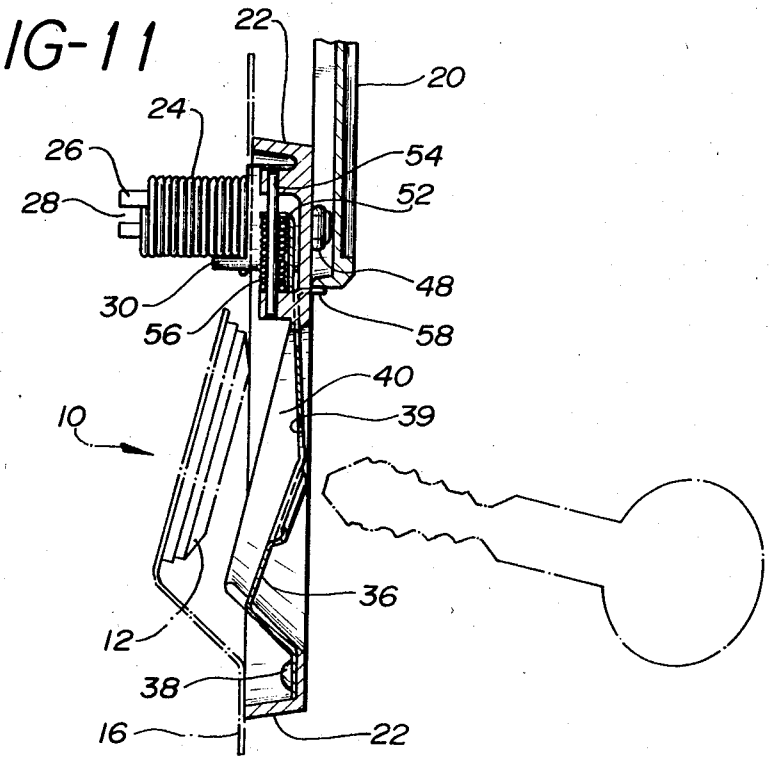
FIG. 11 is a sectional view, similar to FIG. 8, with the cover plate held in its opened position by the first stop.
Figure 10:
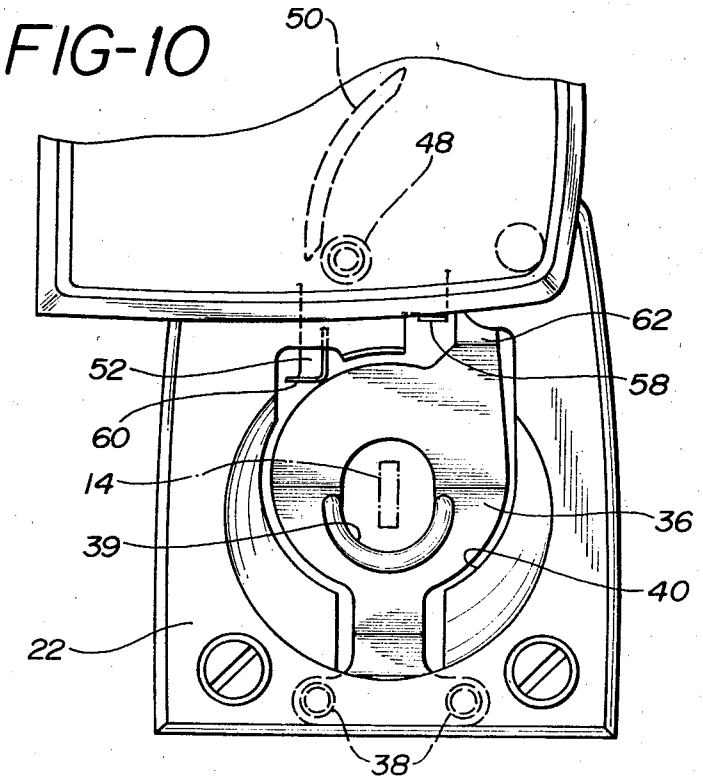
FIG. 10 is a front view, similar to FIG. 7, with the cover plate held in its opened position by a first stop.

In the second embodiment, a pivot means includes a pivot arm 52 which is pivotally mounted on the support plate 22 by pivot shaft 54 for movement about an axis substantially parallel to the cover plate 20. A spring 56 is coiled about shaft 54 and spring biases the arm 52 such that a first stop 58 is urged toward the cover plate 20 and a second stop 60 is urged away from the cover plate 20. When the cover plate 20 is manually pivoted into its opened position, as shown in FIGS. 10–12, the first stop 58 engages the edge of the cover plate 20 and holds it in its opened position.

Figure 14:
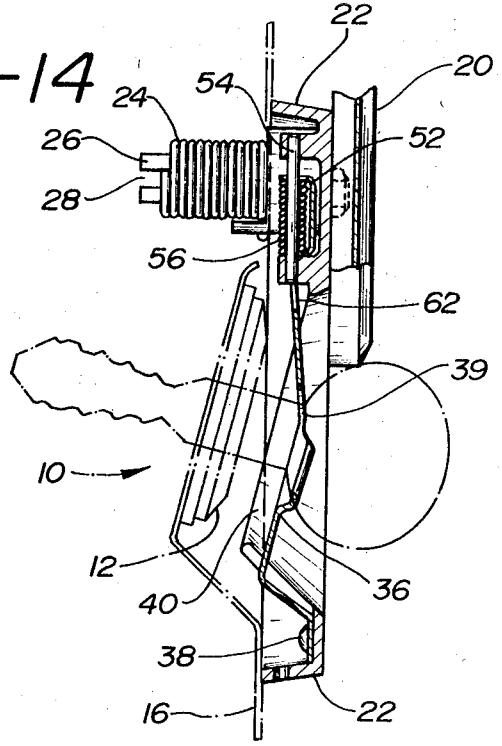
FIG. 14 is a sectional view, similar to FIG. 8, with the cover plate held in its opened position by the second stop.
Figure 15:
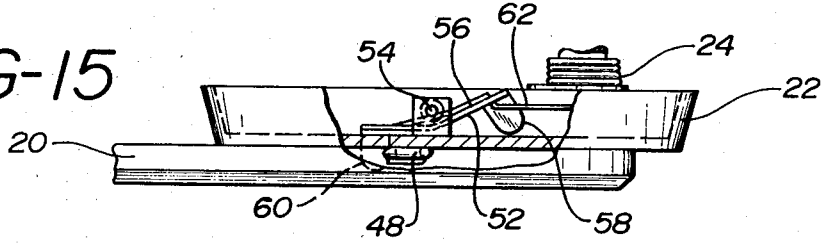
FIG. 15 is a top view with portions broken away to view internal structure, similar to FIG. 9, with the cover plate held in its opened position by the second stop.
Figure 13:
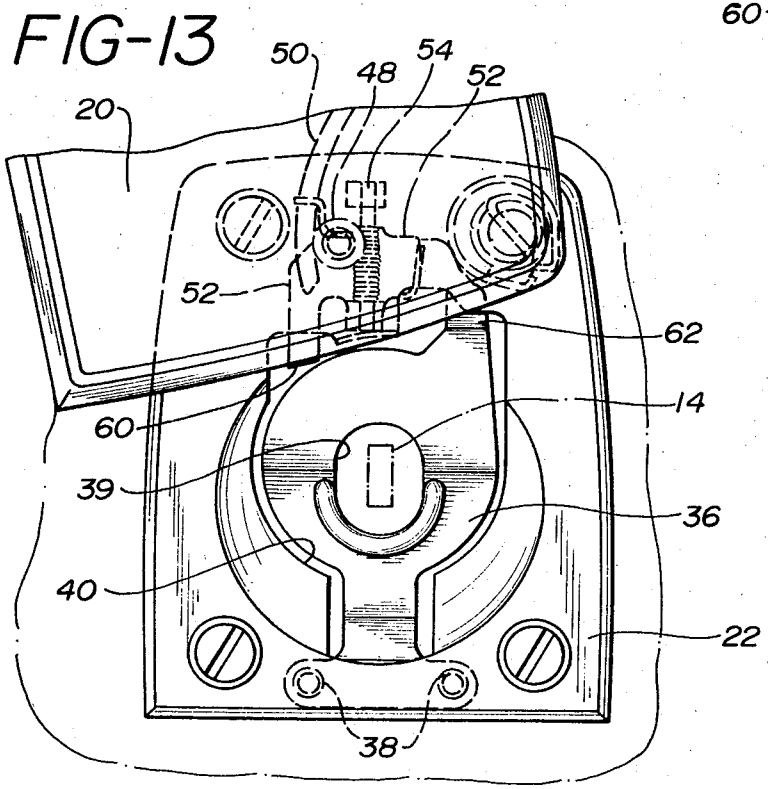
FIG. 13 is a front view, similar to FIG. 7, with the cover plate held in its opened position by a second stop.

The spring detent member 36 includes an actuation leg 62 which is in contact with the leg 52. The leg 62 presses against the arm 52 when a key is inserted into the key opening 14 to pivot the first stop 58 out of the path of the cover plate 20 and, simultaneously, moves the second stop 60 into the path of the cover plate 20, as shown in FIGS. 13–15. The actuation leg 62 holds the second stop 60 in the path of the cover plate 20 until withdrawal of the key from the key opening is initiated. At this time, the spring detent member moves away from the lock 10 and the spring 56 pivots the stop 60 out of the path of the cover plate 20, allowing the plate 20 to be pivoted into its closed position.

It will be appreciated that by utilizing a first stop to engage the cover plate when the plate is manually pivoted into its opened position and a second stop to engage the cover plate when a key is inserted into the key opening, both embodiments of the present invention prevent interference with actuation of the lock by the cover plate, and allow the cover plate to return to its closed position only as the key is withdrawn from the lock.

Having described the invention in detail and by reference to preferred embodiments thereof, it will be apparent that modifications and variations are possible without departing from the scope of the invention defined in the appended claims.

What is claimed is:

1. A cover mechanism for covering a lock, including a lock cylinder having a key opening, mounted on a lock support surface, comprising:

cover plate means, including a cover plate pivotally mounted on a support plate secured to said lock support surface for rotation generally in the plane of said cover plate between a closed position in which said lock is covered and an opened position in which said lock is exposed for insertion of a key into said key opening and a spring means for spring biasing said cover plate toward said closed position, plate detent means for inserting a first stop into the path of said cover plate after said cover plate is pivoted into its opened position so as to hold said cover plate in said opened position, for moving said first stop out of the path of said cover plate and simultaneously moving a second stop into the path of said cover plate in response to insertion of a key into said key opening so as to maintain said cover plate in said opened position, and for thereafter releasing said cover plate by moving said second stop out of the path of said cover plate as said key is withdrawn from said key opening, such that said cover plate may be rotated into said closed position by said spring means.

2. The cover mechanism of claim 1, further comprising damping means for damping the movement of said cover plate from said opened position to said closed position, whereby a key may be fully withdrawn from said key opening prior to movement of said cover plate into said closed position.

3. The cover mechanism of claim 2 in which said damping means comprises a friction element mounted on said support plate, and means defining a friction surface on the side of said cover plate facing said support plate for contacting said friction element and slowing movement of said cover plate from said opened position to said closed position.

4. The cover mechanism of claim 3 in which said friction element comprises an O-ring secured to said support plate.

5. The cover mechanism of claim 1 in which said support plate defines an access opening aligned with said key opening, and in which said cover detent means comprises a spring detent member secured to said support plate, said spring detent member defining an insertion opening aligned with said access opening and with said key opening permitting insertion of a key therethrough into said key opening, said spring detent member further including a first leg defining said first stop and a second leg defining said second stop, said spring detent member being spring biased such that movement of said cover plate into said opened position permits movement of said first stop into the path of said cover plate, and insertion of a key into said key opening contacts said spring detent member causing said first stop to move out of the path of said cover plate and simultaneously causing said second stop to move into the path of said cover plate.

6. The cover mechanism of claim 5 in which said spring detent member is spring biased such that withdrawal of a key from said key opening permits movement of said second stop out of the path of said cover plate.

7. The cover mechanism of claim 6 in which said cover plate defines a contact element extending rearwardly toward said lock support surface and in which said second stop engages said contact element to hold said cover plate in said opened position.

8. The cover mechanism of claim 7 in which said contact element extends rearwardly through a slot in said support plate to contact said second stop.

9. The cover mechanism of claim 1 in which said cover detent means comprises pivot means pivotally mounted on said support plate, for movement about an axis substantially parallel to said cover plate, said pivot means including said first stop and said second stop positioned generally on opposite sides of said axis, said pivot means further including pivot spring means for spring biasing said pivot means to move said first stop into the path of said cover plate when said cover plate is rotated into said opened position, and a spring detent member secured to said support plate, said spring detent member defining an insertion opening aligned with said access opening and with said key opening, permitting insertion of a key therethrough into said key opening, said spring detent member further defining an actuation leg for contacting said pivot means when a key is inserted into said key opening to pivot said first stop out of the path of said cover plate, and simultaneously move said second stop into the path of said cover plate.

10. A cover mechanism for covering a lock having a key opening in a lock support surface, comprising:

a cover plate means, including a cover plate pivotally mounted on a support plate secured to said lock support surface for rotation generally in the plane of the cover plate between a closed position in which the key opening is covered and an opened position in which the key opening is exposed for insertion of a key thereinto, and spring means for spring biasing said cover plate toward said closed position.

a first stop for engaging said cover plate when said cover plate is manually pivoted into said opened position, a second stop, and a spring detent member mounted on said support plate for disengaging said first stop from said cover plate when a key is inserted into said key opening and, simultaneously, causing said second stop to engage said cover plate and hold said cover plate in said opened position until withdrawal of the key from said key opening is initiated, whereby operation of the lock by means of a key may be effected without movement of said cover plate against the key.

11. The cover mechanism of claim 10, further comprising damping means for damping the movement of said cover plate from said opened position to said closed position produced by said spring means, whereby a key may be fully with withdrawn from said key opening prior to movement of said cover plate into said closed position.

12. The cover mechanism of claim 11 in which said damping mens comprises a friction element mounted on said support plate, and means defining a friction surface on the side of said cover plate facing said support plate for contacting said friction element and slowing movement of said cover plate from said opened position to said closed position.

13. The cover mechanism of claim 12 in which said friction element comprises an O-ring secured to said support plate.

14. The cover mechanism of claim 10 in which said support plate defines an access opening and said spring detent member defines an insertion opening, said access opening and said insertion opening being aligned with said key opening such that a key may be inserted into said key opening through said insertion opening and said access opening.

15. The cover mechanism of claim 14 in which said spring detent member includes a first leg connected to said first stop and a second leg connected to said second stop, said spring detent member being spring biased such that movement of said cover plate into said opened position permits movement of said first stop into the path of said cover plate, and insertion of a key into said key opening contacts said spring detent member causing said first stop to move out of the path of said cover plate and simultaneously causing said second stop to move into the path of said cover plate.

16. The cover mechanism of claim 15 in which said spring detent member is spring biased such that withdrawal of a key from said key opening permits movement of said second stop out of the path of said cover plate.

17. The cover mechanism of claim 16 in which said cover plate defines a contact element extending rearwardly toward said lock support surface and in which said second stop engages said contact element to hold said cover plate in said opened position.

18. The cover mechanism of claim 17 in which said contact element extends rearwardly through a slot in said support plate to contact said second stop.

19. The cover mechanism of claim 10 further comprising pivot means, pivotally mounted on said support plate for movement about an axis substantially parallel to said cover plate, said pivot means including a pivot arm supporting said first and second stops on opposite sides of said axis, and pivot spring means for spring biasing said pivot arm to move said first stop into the path of said cover plate when said cover plate is rotated into said opened position, and in which said spring detent member includes an actuation leg for contacting said pivot means when a key is inserted into said key opening to pivot said first stop out of the path of said cover plate, and simultaneously move said second stop into the path of said cover plate when a key is inserted into said key opening, said actuation leg holding said second stop in the path of said cover plate until withdrawal of the key from the key opening is initiated.

* * * * *